US010829925B2

(12) United States Patent
Citro

(10) Patent No.: US 10,829,925 B2
(45) Date of Patent: Nov. 10, 2020

(54) MODULE FOR REALIZING MODULAR BUILDING STRUCTURES

(71) Applicant: Marco Citro, Fisciano (IT)

(72) Inventor: Marco Citro, Fisciano (IT)

( * ) Notice: Subject to any disclaimer, the term of this patent is extended or adjusted under 35 U.S.C. 154(b) by 0 days.

(21) Appl. No.: 15/831,470

(22) Filed: Dec. 5, 2017

(65) Prior Publication Data

US 2018/0155917 A1 Jun. 7, 2018

(30) Foreign Application Priority Data

Dec. 6, 2016 (IT) ..... 102016000124054

(51) Int. Cl.

| | |
|---|---|
| ***E04B 1/02*** | (2006.01) |
| ***E04B 1/04*** | (2006.01) |
| ***E04B 2/62*** | (2006.01) |
| ***E04B 1/88*** | (2006.01) |
| ***E04C 5/12*** | (2006.01) |
| ***E04B 2/08*** | (2006.01) |
| *E04B 1/94* | (2006.01) |
| *E04B 2/02* | (2006.01) |

(52) U.S. Cl.

CPC ..... *E04B 1/043* (2013.01); *E04B 1/88* (2013.01); *E04B 2/08* (2013.01); *E04B 2/62* (2013.01); *E04C 5/125* (2013.01); *E04B 1/945* (2013.01); *E04B 2002/0204* (2013.01); *E04B 2002/0228* (2013.01); *E04B 2002/0254* (2013.01)

(58) Field of Classification Search

CPC ..... B32B 3/06; B32B 13/045; B32B 3/08; B32B 2260/026; E04C 2/296; E04C 2/26; E04C 2/243; E04C 1/40; E04B 1/14; E04B 2/08; E04B 2002/0247; E04B 2002/0254; F27D 1/066; F27D 1/08

See application file for complete search history.

(56) References Cited

U.S. PATENT DOCUMENTS

| | | | | | |
|---|---|---|---|---|---|
| 1,776,254 | A * | 9/1930 | Dozier | E04F 13/04 | 52/446 |
| 4,343,125 | A * | 8/1982 | Shubow | E04B 1/04 | 52/236.8 |
| 5,485,703 | A * | 1/1996 | Nordahl | E04B 2/08 | 52/562 |
| 5,678,373 | A * | 10/1997 | Franklin | E04B 2/14 | 52/223.7 |

(Continued)

*Primary Examiner* — Gisele D Ford
(74) *Attorney, Agent, or Firm* — Mark M. Friedman

(57) ABSTRACT

A module for realizing modular building structures comprises a bearing block having pairs of flat faces with complementary shaped joints for coupling with further similar modules arranged in side by side position, means for anchoring the bearing block to bearing blocks of side-by-side modules for realizing the building structure. The anchoring means comprise one pair of passages mutually perpendicular and staggered along a first transverse direction, the passages extending in the block from respective flat faces. The anchoring means also comprise reinforcing bars adapted to be inserted in a pair of consecutive passages belonging to two mutually side-by-side modules to define a reinforcement meshed armor. Each bar has ends associated with male and female connecting elements for coupling with facing ends of contiguous bars belonging to a side-by-side module.

10 Claims, 5 Drawing Sheets

(56) References Cited

U.S. PATENT DOCUMENTS 5,787,675 A * 8/1998 Futagi ..... E04B 2/702 411/389
5,921,046 A * 7/1999 Hammond, Jr. ..... E04B 1/12 52/220.2
5,964,067 A * 10/1999 Lehner ..... E04C 1/40 52/220.2
6,178,714 B1 * 1/2001 Carney, Jr. ..... E04B 1/34315 52/223.7
6,282,859 B1 * 9/2001 Van Der Heijden ..... E04B 2/08 52/585.1
6,295,786 B1 * 10/2001 Lee ..... B32B 5/22 52/745.19
6,513,293 B2 * 2/2003 Miller ..... E04C 1/397 52/309.12
6,513,296 B1 * 2/2003 Baden ..... E04B 2/16 411/521
6,931,809 B1 * 8/2005 Brown ..... E04B 1/762 156/90
8,776,476 B2 * 7/2014 Propst ..... B32B 3/06 264/256
9,315,992 B2 * 4/2016 Carey ..... E04B 2/46
2002/0014050 A1 * 2/2002 Van Der Heijden ..... E04B 2/08 52/585.1
2002/0108336 A1 * 8/2002 Maimon ..... E04C 2/049 52/309.9
2004/0020145 A1 * 2/2004 Matsufuji ..... E04B 2/42 52/223.7
2005/0036829 A1 * 2/2005 Trull ..... A01G 9/16 403/170
2005/0252118 A1 * 11/2005 Matsufuji ..... E04B 2/02 52/223.7
2006/0272264 A1 * 12/2006 Parker ..... E04B 2/06 52/605
2008/0110124 A1 * 5/2008 Buse ..... E04B 2/06 52/562
2008/0245005 A1 * 10/2008 Fennell ..... E04C 1/40 52/223.7
2011/0162318 A1 * 7/2011 Bucheger ..... E04B 2/44 52/745.1
2011/0203193 A1 * 8/2011 Robertson ..... B32B 37/18 52/61
2012/0324820 A1 * 12/2012 Drew ..... E04B 2/16 52/600
2013/0036700 A1 * 2/2013 Speer ..... E04B 2/16 52/583.1
2014/0202111 A1 * 7/2014 Drew ..... E04B 2/16 52/589.1
2014/0230357 A1 * 8/2014 Kovitch ..... E04B 2/08 52/588.1
2015/0300006 A1 * 10/2015 Lanese ..... E04B 2/06 52/585.1
2017/0122464 A1 * 5/2017 Dagesse ..... C08J 9/04

* cited by examiner

MODULE FOR REALIZING MODULAR BUILDING STRUCTURES

TECHNICAL FIELD

The present invention finds application in the technical sector of building and has as its object a module for realizing modular building structures and a modular building structure realized through the coupling of a plurality of modules according to the invention.

STATE OF THE ART

As known, in the building sector there is an ever-increasing use of modular prefabricated elements to realize walls, load-bearing structures or other parts of buildings in a quick and economic manner, without having to resort to traditional methods.

One of the main drawbacks of the known solutions is represented by the fact that such prefabricated structures show reduced strength and elasticity compared to traditional structures, with consequent limited anti-seismic properties.

As matter of fact, the known prefabricated structures are generally formed by panels anchored to each other by external elements, such as brackets or the like, which also increase assembly time and consequently the overall construction costs of the structure.

Moreover, the known anchoring methods do not allow to realize stable and precise couplings, with consequent reduction of the insulating properties.

Furthermore, the known modular structures are poorly configurable, have low impact resistance and, not least, are largely made of ecologically non-compatible materials.

SCOPE OF THE INVENTION

The object of the present invention is to overcome the above drawbacks by providing a module for realizing modular building structures that is particularly efficient and relatively cost-effective.

A particular object is to provide a module for realizing modular building structures that allows the construction of modular building structures that have at the same time high strength and flexibility and which ensure high anti-seismic degree and resistance to lateral impacts.

Another particular object is to provide a module for realizing modular building structures which allows quick and precise coupling with the other modules.

Another particular object is to provide a module for realizing modular building structures which are environmentally friendly and which allow to realize structures with a high coefficient of insulation, both thermal and acoustic.

These objects, as well as others that will become more apparent hereinafter, are achieved by a module for realizing modular building structures formed by a plurality of side by side modules arranged in horizontal rows and/or vertical columns, wherein a module, according to claim 1, comprises a bearing block having a side surface with mutually opposite pairs of flat faces and each having complementary shaped joints for its coupling with further similar modules arranged in side by side position, anchoring means of the bearing block to one or more bearing blocks of adjacent modules for realizing a wall or other building structure, wherein the anchoring means comprise at least one pair of passages mutually perpendicular and staggered along a first transverse direction, which passages extend in the block from respective flat faces, at least one pair of reinforcing bars being provided and having a length substantially close to that of the respective passages, each bar being adapted to be inserted in a pair of consecutive passages belonging to two mutually adjacent modules to define a reinforcement mesh.

Advantageous embodiments of the invention are obtained according to the dependent claims.

BRIEF DISCLOSURE OF THE DRAWINGS

Further features and advantages of the invention will become clearer in the light of the detailed description of some preferred but not exclusive embodiments of the module according to the invention and of a building structure made by the modules, shown by way of non-limiting example with the aid of the attached drawing tables, wherein.

BEST MODES OF CARRYING OUT THE INVENTION

Figure 1:
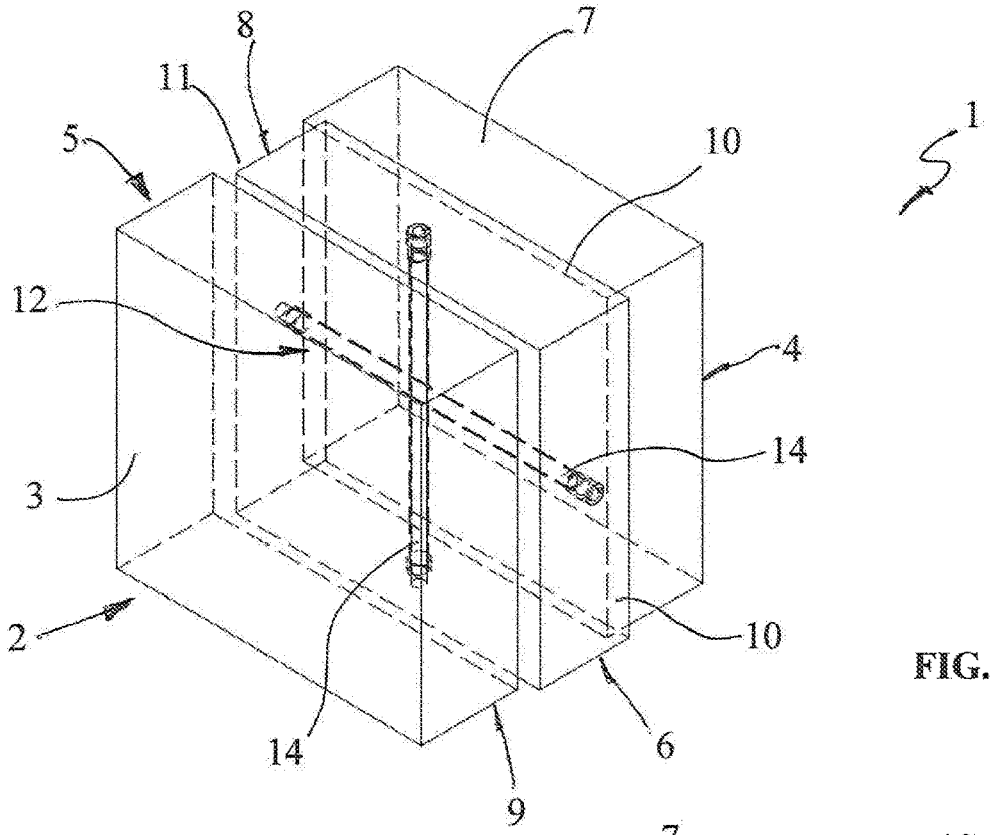
FIG. 1 is a perspective view of a module of the invention in a first preferred embodiment.
Figure 2:
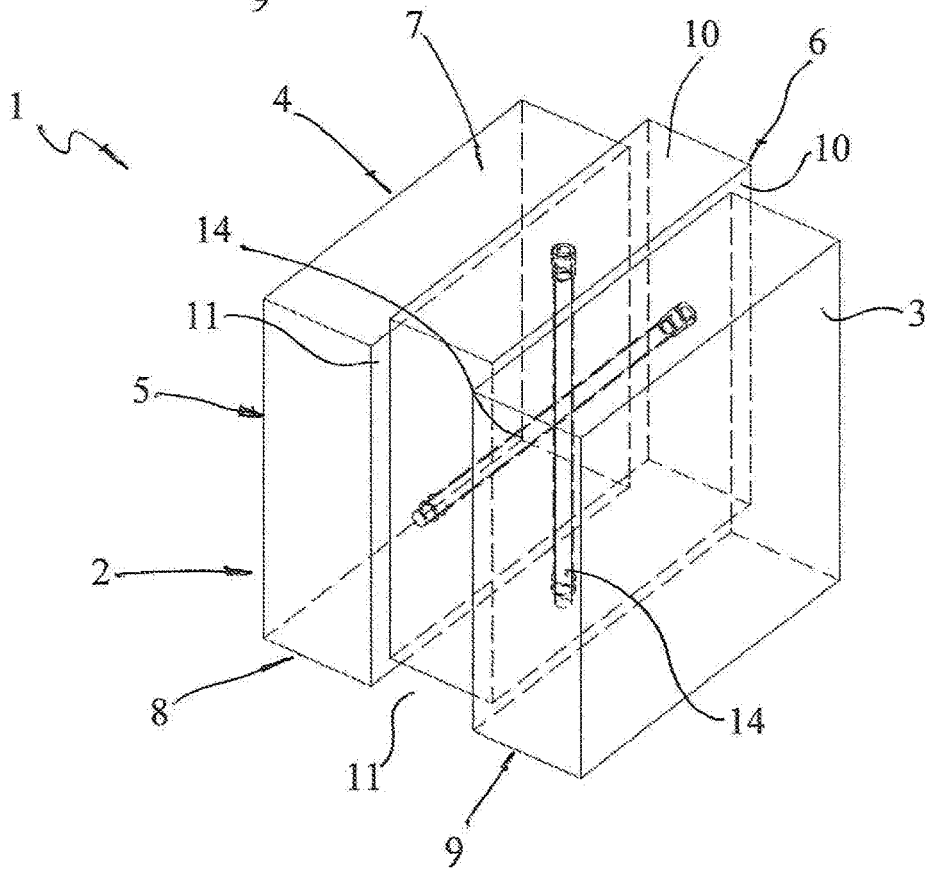
FIG. 2 is a second perspective view of the module of FIG. 1.
Figure 3:
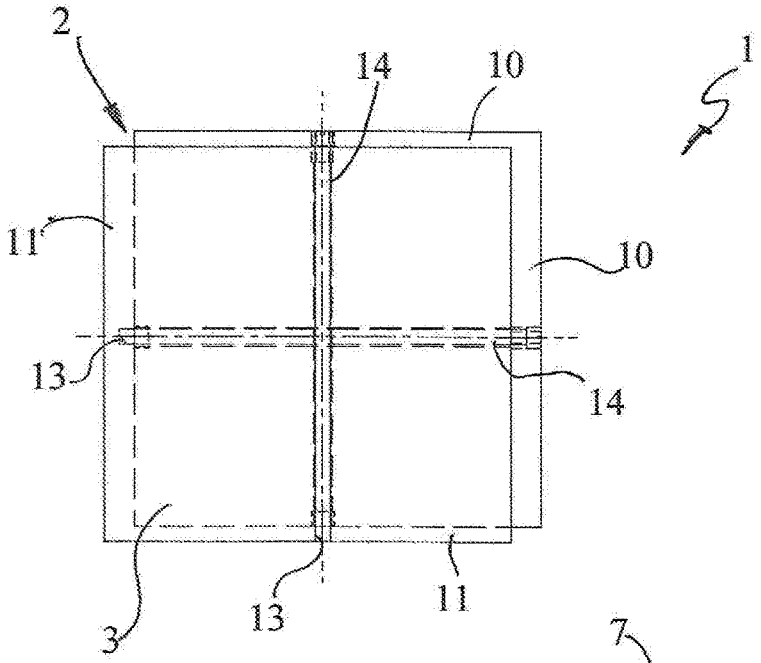
FIG. 3 is a front view of the module of FIG. 1.
Figure 4:
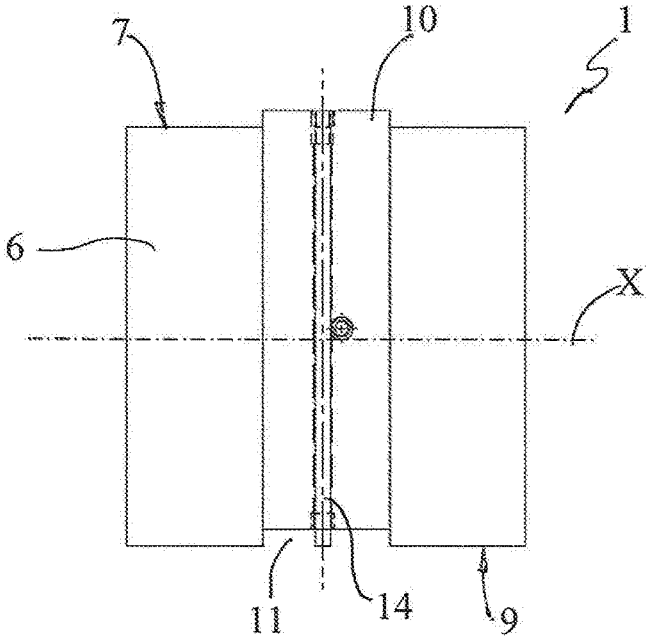
FIG. 4 is a side view of the module of FIG. 1.
Figure 5:
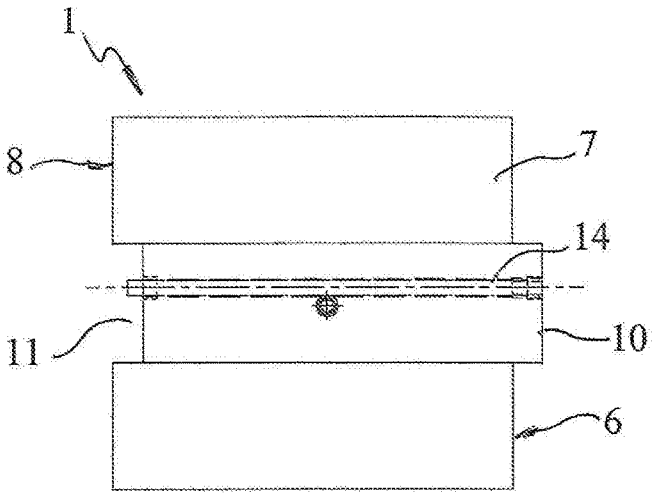
FIG. 5 is a top view of the module of FIG. 1.

FIG. 1 and FIG. 2 show a first preferred but not exclusive embodiment of a module for realizing modular building structures according to the invention.

In particular, the module, generically indicated by 1, will be designed to be assembled with a plurality of similar modules arranged side by side according to horizontal rows and/or vertical columns for the construction of building walls or other structures, also of a bearing nature.

According to the illustrated embodiment, the module 1 essentially comprises a bearing block 2, preferably having a substantially cubic or parallelepiped shape, having a substantially flat front face 3 and a substantially flat rear face 4 and a side surface 5.

The latter has two pairs of mutually opposed flat surfaces 6-9 each having joints complementarily shaped with each other for coupling with other similar modules arranged in a side-by-side position.

According to a first variant, the block 2 may comprise a cube-shaped or parallelepiped-shape unitary base body, preferably empty inside, on whose side surface 5 there are bands of the same extension applied so that first faces 6, 7 of the side surfaces 5, mutually orthogonal and contiguous with each other, will have a projection 10, while second faces 8, 9, opposite to respective first faces 6, 7 and orthogonal and contiguous to each other, will have a respective recess 11 complementarily shaped with respect of the projection 10 on the opposite first face 6, 7.

Figure 6:
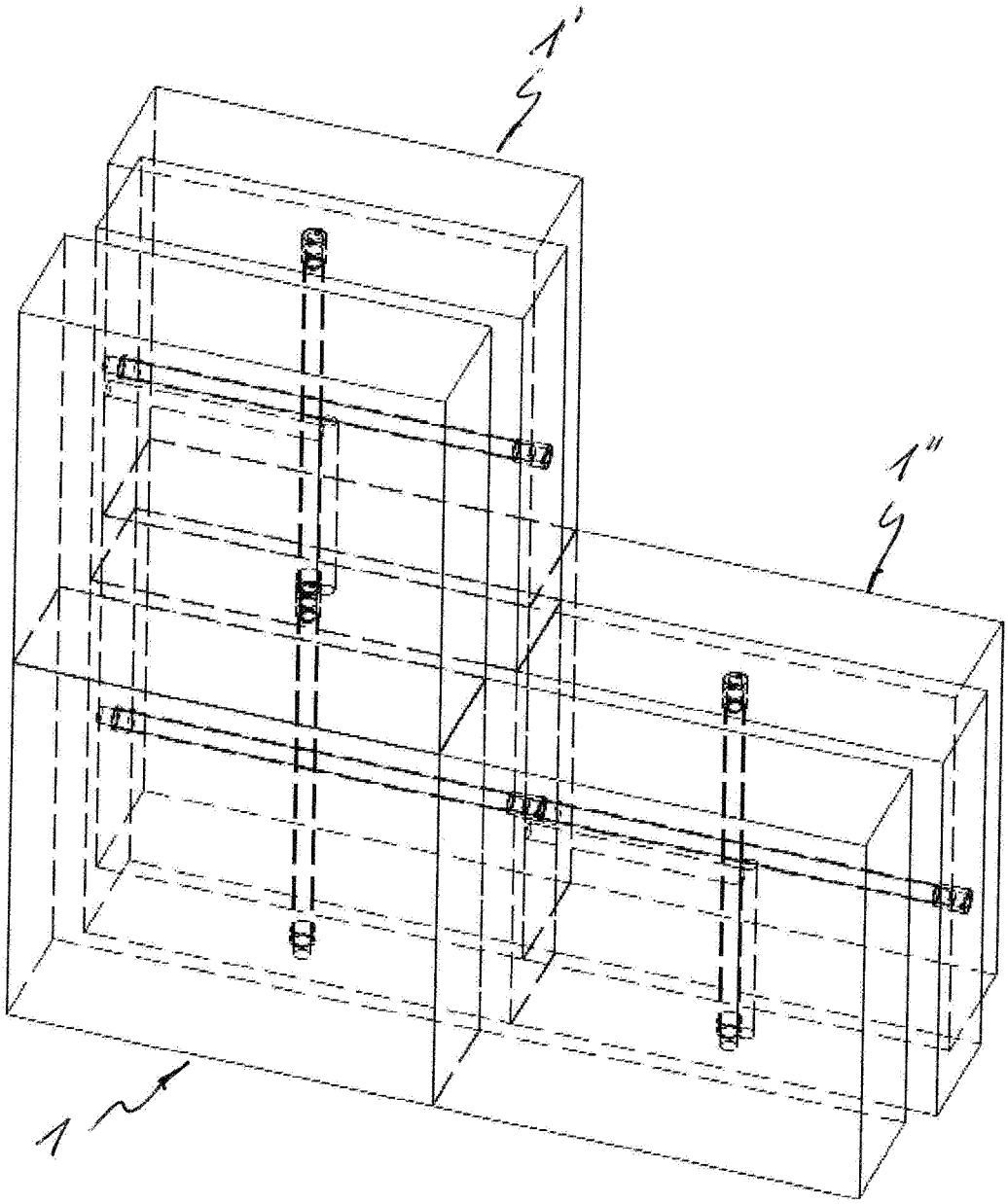
FIG. 6 is a perspective view of a portion of a structure assembled through a plurality of modules according FIG. 1.

In this way, the projections 10 of the module 1 may be snap fitted into corresponding recesses 11 of respective two further modules 1', 1" in side-by-side position and the recesses 11 of the module 1 may house corresponding projections 10 of further modules in side-by-side position, as shown in FIG. 6. Accordingly, each module 1 may be coupled to further four modules.

According to a further variant, the block 2 may be composed of three parallelepiped-shaped bodies side by side along the directrix of the side surface 5, with the central body offset along two directions orthogonal to each other and to the directrix X to define the projections 10 and the recesses 11.

The block 2 also houses anchoring means 12 for anchoring it to one or more bearing blocks of modules 1', 1" placed side by side for the construction of the wall or other building structure.

In particular, the anchoring means 12 comprise a pair of mutually orthogonal passages 13 arranged on mutually parallel planes offset along a first transverse direction X parallel to the directrix of the side surface 5.

Each passage 13 extends inside the block 2 between respective pairs of opposite flat faces 6, 8; 7, 9 of the side surface 5 and removably houses thereinside a respective reinforcing bar 14 having a length substantially close to that of the respective passage 13.

The bars 14 may move into the respective passages 13 so as to be inserted simultaneously in a pair of consecutive and coaxial passages belonging to two mutually side-by-side modules to define a mesh reinforcement armor, as will become clearer hereinafter.

In this manner, each assembled module 1 will house a pair of mutually orthogonal and tangent bars 14 which may be either solid or hollow.

According to a first preferred embodiment, each bar 14 comprises a pair of ends 15, 16 respectively shaped as a male and a female for coupling respectively with a female end 16 and male end 15 of a bar 14 belonging to a side-by-side module 1', 1".

Preferably, the female end 16 may have an internally threaded surface suitable for screwing with the counter-threaded outer surface of a male end 15 of a bar 14 of a side-by-side module 1', 1".

Therefore, in this embodiment, preferred but not limiting, the bar 14 will have an essentially cylindrical shape and will be externally smooth except at the male end 15, where it will be externally threaded.

For this purpose, the male end 15 will have a diameter smaller than that of the central body of the bar 14, to be inserted in a complementary cylindrical bore of the female end 16 of the side bar 14.

Suitably, the length of the male end 15 and female end 16 will be substantially equal to the thickness of the respective faces 6-9 of the block 2.

The screwing of two contiguous metal bars 14 ensures that at the level of the connecting portion the thickness of the bar is equal to that of the remaining part, corresponding to the non-threaded part.

Figure 7:
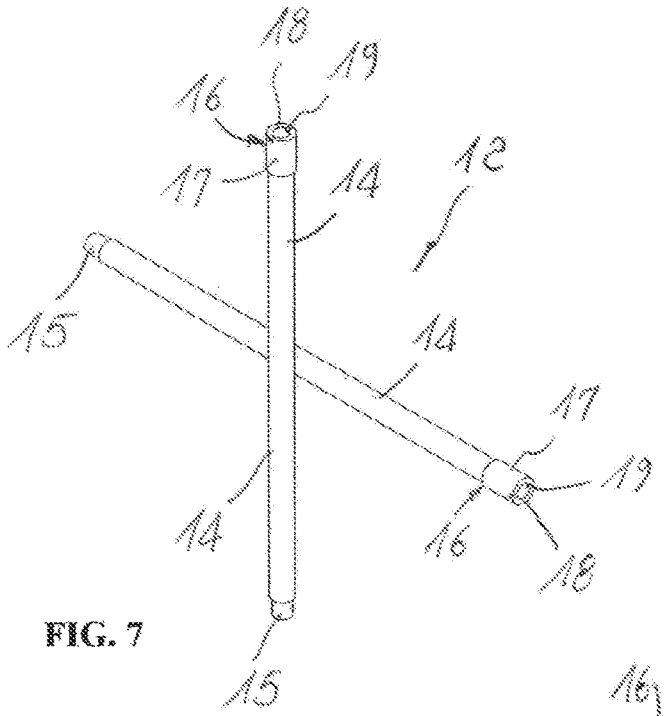
FIG. 7 is a perspective view of a pair of bars of the module of FIG. 1 according to a first variant.
Figure 8:
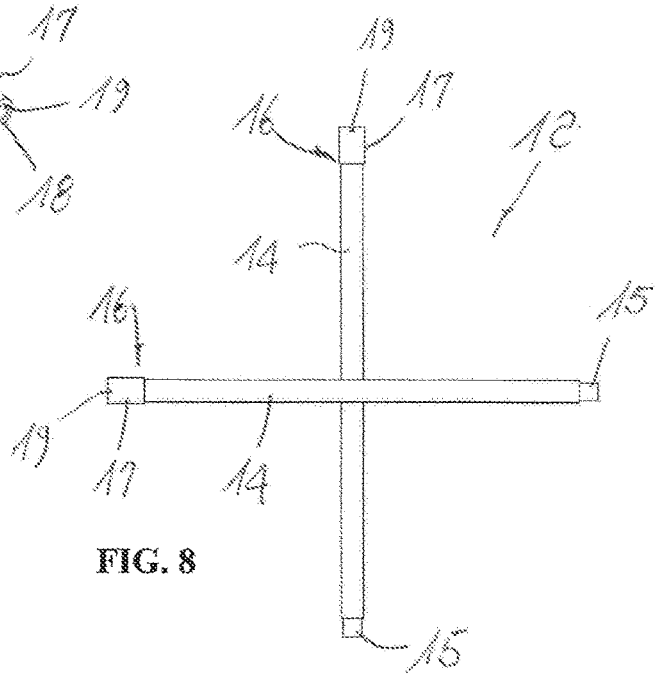
FIG. 8 is a front view of the pair of bars of FIG. 7.

As shown in FIG. 7, the female end 16 of the bar 14 may also comprise an enlarged cylindrical head 17 having an outer diameter greater than the diameter of the bar 14 and an axial passage 18 complementarily shaped with respect of the male end 15 for inserting and consequently screwing the latter inside the female end 16 of a bar 14 belonging to a side-by-side module 1', 1".

The cylindrical head 17, which in a not shown particular variant will have a discoidal shape and will be welded to the female end 16, will have the function of stopping the bar 14 ensuring correct tightening between two consecutive modules.

Appropriately, in the faces of the module there may be circular grooves of the same thickness of the discoidal head and complementary thereto to guarantee the housing thereof when two adjacent modules are joined together.

In particular, the faces 6-9 will have such a thickness to allow the connecting portions of two contiguous bars to be entirely contained within the thickness of the corresponding faces, so as to ensure increased stability for the structures made with the modules.

This kind of bar guarantees a lower weight with the same strength. Moreover, the screwing of consecutive bars ensures the formation of a tube having a thickness equal to that of the tubular bars and a length equal to the number of contiguous bars screwed in succession.

Advantageously, the female end 16, or the cylindrical head 17, may have a diametral front slot 19 adapted to be engaged by a screwing tool, such as a common screwdriver with a slotted head, to facilitate the coupling between the adjacent bars.

The reinforcing bars 14 will preferably be made of metallic material and will form the inner core of a reinforcing element also provided with a sheath 20 of plastic material sliding with respect to the metal core or bar 14.

Suitably, the sheath 20 will have a length equal to that of the bar or core 14 minus the length of the female end 16 or male end 15 and an inner diameter equal to the outer diameter of the bars 14.

According to an alternative embodiment, not shown, the bars 14 will be solid and threaded at the ends 15, 16, possibly being smooth in the remaining portion, with both ends 15, 16 which will act as a male element.

In this case there will be an externally smooth and internally threaded sleeve which will function as a female element for both ends 15, 16.

The sleeve will also be cut at one end to guarantee the screwing function of the entire bar 14 integral therewith through the end which is inserted into the free and cut portion of the sleeve of a contiguous bar.

In this kind of bar, the disc-shaped head 17 having constraining function is integral neither with the sleeve nor with the bar, but with the sheath 20 of a length shorter than the bar itself.

Figure 9:
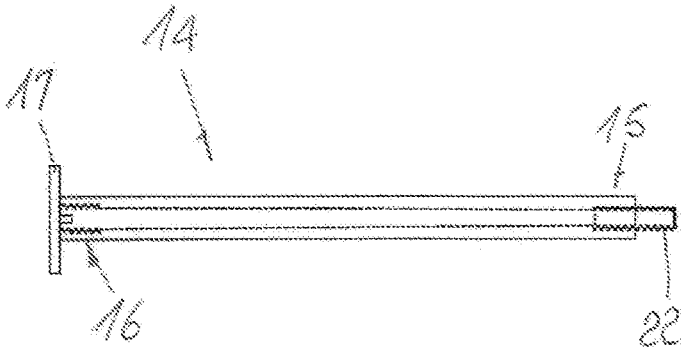
FIG. 9 is a side view of a bar according to a further variant.
Figure 10:
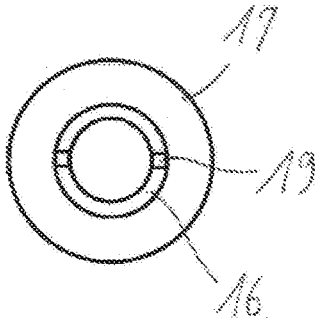
FIG. 10 is a front view of the bar of FIG. 9.

According to yet another variant, shown in FIG. 9, the metal bar 14 will be internally empty as a tube having a predetermined thickness and inner diameter, smooth both externally and internally and threaded only at the ends 15, 16, both with female function, one of which being cut at the top for guarantee the screwing function of the metal bar 14, as visible from the front view of FIG. 10.

In this case there will be a male cylindrical element 22 which is threaded externally and has an outer diameter equal to the inner diameter of the bar 14 for screwing to the adjacent female ends 15, 16 of two consecutive bars 14.

The screwing of two contiguous metal bars 14 ensures that at the connection portion there is a thickness greater than the remaining portion, since the bars will be solid at the end portions.

One of the two ends will be integral with the metallic discoidal head 17 with constraining function of the length to ensure that each bar screwed to the next respects this distance.

Also in this case, two faces of the module will be provided with circular recesses of the same thickness as the discoidal head 17 and complementary thereto to guarantee the housing when two adjacent modules are joined together.

The covering sheath 20 is always positioned inside the module and is of the same length as the bar 14.

Figure 11:
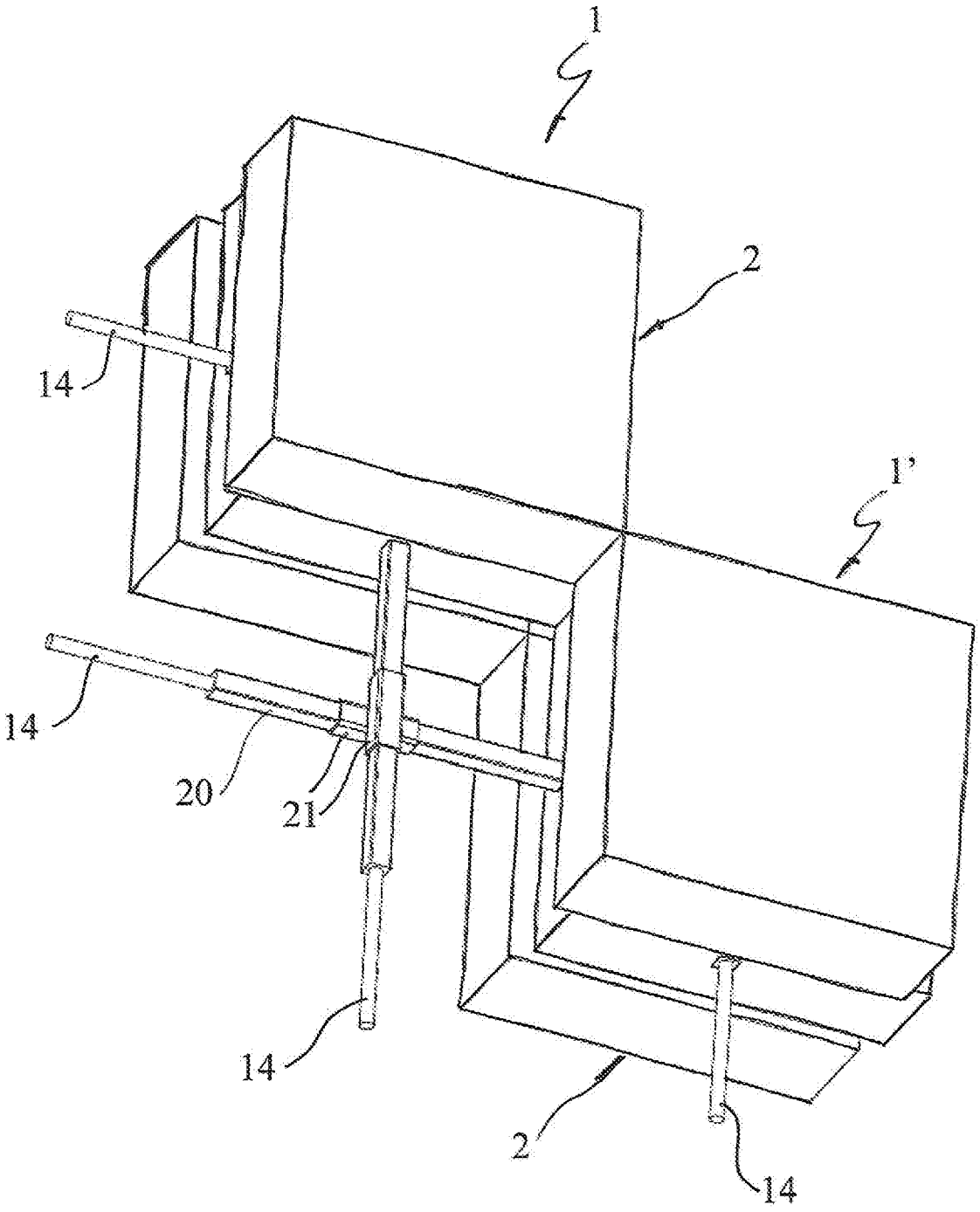
FIG. 11 is a perspective view of a portion of a structure assembled through a plurality of modules according to a second embodiment.

FIG. 11 shows a variant of the module 1 wherein the cylindrical bars 14 are inserted into a sheath 20 with an outer square section adapted to insert themselves in a pair of sleeves 21 having complementary section orthogonal to each other for perpendicular positioning of the bars 14.

In this case, the bars 14 may not be threaded at the ends because the coupling between consecutive bars will be made by the same sleeves 21 which will each hold the opposite ends of two side-by-side bars 14 of two side-by-side modules.

The materials used for the block 2 may vary according to the requirements and are not limitative of the present invention.

According to a preferred embodiment, the bearing block 2 will be made of composite material, such as wood or wood-based material, generally beech or fir, and will be internally hollow to house the reinforcing bars 14.

Advantageously, all the faces 6-9 will be made of wood or of the above wood-based material, so as to ensure high resistance to tensile and compressive forces at each side and to obtain stable locking into position of the bars 14, both vertical and horizontal, present in each module, without it being necessary to make the anchoring between the modules more solid by using cement mortars or similar, thus facilitating both assembly and disassembly.

The so realized modules will be adapted to form a structure having sufficient rigidity to allow it to be used also to build load-bearing walls of multi-storey buildings.

Furthermore, the block 2 may be filled with a thermally and/or acoustically insulating material, for example expanded cellulose, optionally pretreated with boron salts, or a polyurethane foam adapted to increase the fire-retardant coefficient of the module.

In this way, the module 1 will have a significantly reduced heat transfer coefficient for the construction of walls or structures adapted to guarantee significant energy savings both for winter heating and for summer cooling.

A layer of waterproofing material may also be provided on the front face designed to be placed towards the outside of the building.

The shape and dimensions of the modules are not relevant to the scope of protection of the present invention.

In a particular embodiment, each module may have a substantially cubic shape, for example with dimensions equal to 25 cm per side.

For load-bearing walls it will also be possible to have modules with dimensions equal to H×L×P=25×50×25 cm or, again, H×L×P=50×25×25, H×L×P=50×50×25 cm, H×L×P=25×100×25 cm, H×L×P=50×100×25 cm.

For inner walls it is also possible to have modules with dimensions H×L×P=25×50×10 cm, H×L×P=50×25×10 cm, H×L×P=50×50×10 cm, H×L×P=25×100×10 cm, H×L×P=50×100×10 cm.

Further variants of the basic module may include a dimension H×L×P=25×25×25 cm and H×L×P=25×25×10 cm.

The reinforcing bars 14 will have a length equal to the width or the height of the block, depending on whether they are to be arranged horizontally or vertically.

The blocks 2 may also provide spaces for housing electrical junction boxes or for sockets, conduits for the arrangement of cables and/or pipes.

A further structural variant provides that the block 2 has an L- or T-shape to be used in the corners of the load-bearing walls or internal walls for the construction of load-bearing or internal walls perpendicular to each other, always guaranteeing high construction efficiency in a short time, already knowing the necessary arrangement of each module inside the wall.

The assembly of a wall or other structure by means of the modules according to the invention will generally take place by arranging the modules in succession along horizontal rows and coupling the modules horizontally side by side by means of the joints.

In particular, the projection 10 of one of the first faces 6, 7 of the side surface 5 of a module 1 will snugly fit into the recess 11 in the opposed second face 8, 9 of the side surface 5 of a further module 1', 1" in side-by-side relationship.

To guarantee the tightness of the coupling, the horizontal bars 14 of the side-by-side modules will be coupled according to the type of bars selected, for example by screwing the male end 15 of one of the bars 14 into the female end 16 of the another bar 14, so that each bar 14 penetrates at least partially into the thickness of the bearing block 2 of a side-by-side module, ensuring continuity between consecutive bars, which will thus be joined together and held together within a horizontally arranged junction portion common to the two adjacent modules.

In the same way you will proceed in a vertical direction so as to have columns of superimposed modules.

Once the assembly has been completed, a wall comprising a plurality of modules arranged in horizontal rows and vertical columns will be obtained, within which a reinforcement armor with square or rectangular meshes having sides equal to the length of the bars is provided.

The mesh reinforcement will guarantee strength and at the same time structural flexibility to give resistance to impacts of various kinds or to stresses of both seismic and undulating seismic waves, avoiding the load-bearing wall and the whole building to collapse.

The particular features of the modules will allow the quick and precise construction of load-bearing walls, without using of cement mortars or special glues, also avoiding the use of pillars.

The module according to the invention is susceptible of numerous modifications and variations, all of which are within the inventive concept expressed in the appended claims. All the details may be replaced by other technically equivalent elements, and the materials and tools may be different according to requirements, without departing from the scope of protection of the present invention.

The invention claimed is:

1. The module for realizing modular building structures, wherein a modular building structures comprises a plurality of side by side modules arranged in horizontal rows and/or vertical columns, wherein the module comprises:

a bearing block with a substantially cubic or parallelepiped shape having a side surface with two pairs of mutually opposite flat faces, each pair having a first face and a second face opposite to the first face, the first faces being orthogonal and contiguous with each other and the second faces being orthogonal and contiguous to each other, each of said flat faces having a joint complementary shaped with respect of the joint of the opposite flat face;

anchoring means for anchoring the bearing block to one or more bearing blocks of side-by-side modules for realizing a wall or other building structure;

wherein the anchoring means comprise at least one pair of passages realized into the blocks, the passages being mutually perpendicular and arranged on mutually parallel planes offset along a first transverse direction, each passages extending in the block between respective mutually opposite flat faces of a respective pair of the two pairs;

wherein the anchoring means comprise at least one pair of reinforcing bars, each bar of the pair being movably housed in one of the passages of the pair and having a length substantially close to that of the passage wherein it is housed, each bar being adapted to be inserted in a pair of consecutive passages belonging to two mutually side-by-side modules to define a reinforcement meshed armor, wherein each bar has one pair of ends, one end of the pair being associated with a male connecting element and the other end of the pair being associated with a female connecting element;

wherein each of the first faces of the side surface has a projection and each of the second faces of the side surface has a respective recess complementarily shaped with respect of the projection of the opposite first face, wherein all the faces of the side surface are made of wood or of a wood-based material and have such a thickness to allow the connecting element of two contiguous bars to be entirely contained within the thickness of the corresponding face, the male end and the female end of the bars having respective axial length equal to the maximum thickness of the flat faces provided with the joints, wherein the faces of the two pairs have circular grooves complementary shaped with respect to the connecting elements to guarantee the housing thereof when two adjacent modules are joined together.

2. The module of claim 1, wherein the female end has an internally threaded surface adapted to be screwed to the counter-threaded outer surface of a male end of a bar of another module placed in side-by-side relationship.

3. The module of claim 1, wherein the female end of the bar comprises an enlarged cylindrical head having an outer diameter greater than the diameter of the bar and an axial passage complementarily shaped with respect of the male end.

4. The module of claim 1, wherein each bar comprises a pair of externally threaded ends, a plurality of internally threaded female tubular sleeves being further provided and suitable for coupling by screwing with pairs of facing ends of contiguous bars belonging to another module placed in side-by-side relationship.

5. The module of claim 1, wherein each bar is hollow with a pair of internally threaded ends, there being further provided an externally threaded solid cylindrical male element having an outer diameter equal to the inner diameter of the hollow bar for screwing to the adjacent female ends of two consecutive bars belonging to another module placed in side-by-side relationship.

6. The module of claim 1, wherein the female end has a front diametrical slot adapted to be engaged by a screwing tool.

7. The module of claim 1, wherein each reinforcing bar comprises a core made of metallic material provided with the male and female ends and an outer plastic sheath slidable with respect to the metal core.

8. The module of claim 7, wherein the sheath has a length equal to that of the core minus the length of the male or female end.

9. The module of claim 1, wherein the bearing block has a cubic shape and is internally hollow to house the pair of reinforcing bars.

10. The module of claim 9, wherein the block is filled with a heat and/or acoustically insulating material.

* * * * *